United States Patent [19]

Murdock

[11] 4,288,959

[45] Sep. 15, 1981

[54] ROOFING OR SIDING ARTICLE

[76] Inventor: John B. Murdock, 10 Manchester Rd., Moylan, Pa. 19065

[21] Appl. No.: 40,587

[22] Filed: May 21, 1979

[51] Int. Cl.[3] ..... E04D 1/28

[52] U.S. Cl. ..... 52/518; 52/556; 52/559; 52/560

[58] Field of Search ..... 52/559, 560, 518, 556, 52/313, 316; 106/116

[56] References Cited

U.S. PATENT DOCUMENTS

| | | | |
|---|---|---|---|
| 22,350 | 12/1858 | Clay | 52/560 |
| 43,717 | 8/1864 | Squire | 52/560 |
| 173,957 | 2/1876 | Inman | 52/560 |
| 1,674,630 | 6/1928 | Beckman | 52/560 |
| 2,626,872 | 1/1953 | Miscall | 106/122 |
| 2,634,208 | 4/1953 | Miscall et al. | 106/122 X |
| 2,797,201 | 6/1957 | Veatch et al. | 52/309.4 X |
| 2,957,775 | 10/1960 | Jacobson | 106/116 |
| 3,319,390 | 5/1967 | Pannullo et al. | 52/556 X |
| 4,015,039 | 3/1977 | Segal et al. | 260/37 R X |

OTHER PUBLICATIONS

Mason, P. J. et al., *The Technology of Plastics and Rescas,* Fourth Printing, D. Van Nostrand Company, Inc., New York, 1945, pp. 377-378.

*Primary Examiner*—Evan K. Lawrence
*Attorney, Agent, or Firm*—Eugene E. Renz, Jr.

[57] ABSTRACT

A weather and fire-resistant roofing or siding article, such as a shingle or panel, having a high thermal insulation value is cut from insulating board comprising fiber, binder and about 50 to 90% by weight expanded perlite. The article has adjacent butt and nailing sections, the butt section being substantially uniformly the maximum thickness of the article and having a water- and weather-resistant coating composition on the outer surface to be exposed to the weather, and the nailing section having a non-tapered outer surface and an inner surface tapered from the maximum thickness at the junction of the two sections to a minimum thickness at the edge of the article. The outer surface of the butt section may be machined or pressed or embossed to provide a decorative surface simulating a wood shake, and coated with a sun- and moisture-proof coating such as asphalt and roofing granules.

7 Claims, 6 Drawing Figures

ROOFING OR SIDING ARTICLE

BACKGROUND OF THE INVENTION

The present invention relates to the roofing and siding art and more particularly to improved lightweight, decorative and fire-resistant roofing and siding having substantial insulating value.

Conventional roofing and siding of the prior art includes the traditional wood shingles and siding, concrete and clay tiles, asphalt and asbestos shingles and metal siding. Most of these roofing materials require periodic maintenance to keep them in satisfactory condition. Another disadvantage of such roofing materials is that they are not inherently good insulators and thus require underlying auxilliary thermal insulation in the roof, ceiling or wall structure. While asphalt and wood shingles are highly decorative, they have the disadvantage of having low fire-resistance and, indeed in the case of wood shingles are prohibited by fire regulations in some localities and almost universally impose increased costs for fire insurance. Concrete and clay tiles have the disadvantage of substantial weight, thus increasing the cost of the underlying structures. It has long been apparent, therefore, that a need exists in the art for lightweight, decorative, fire-resistant siding or roofing having good thermal insulating properties.

THE PRIOR ART

Building board having good fire-resistance and insulating properties has been available for many years, but has only been used as sheathing beneath over conventional siding or roofing, since it was neither sufficiently weather-resistant nor decorative to be used on the exterior of a building. Typical of such building board are the products described in Miscall et al., U.S. Pat. Nos. 2,626,846 and 2,626,872 issued Jan. 27, 1953; and U.S. Pat. Nos. 2,634,207 and 2,634,208 issued Apr. 7, 1953. The Miscall et al. patent described composition boards consisting essentially of fibers and asphalt-coated essentially cellular expanded perlite; the fibers making up 90 to 25% by weight of the composition; the remaining 10 to 70% being coated perlite. The perlite has a particle size less than 20 mesh and a bulk density of 1 to 20 pounds per cubic foot and is coated with 1 to 150 pounds per cubic foot of asphalt melting at 100° to 250° F. The asphalt-coated perlite is present essentially as discrete particles. The fibers having a length no greater than about 20 mm but the average length of the fibers is substantially greater than the diameter of the perlite particles. The fibers may be of organic or unorganic origin and include pulped newsprint, bagasse fiber, rock wool fibers, glass wool, and asbestos wool or mixtures of such fibers.

The Miscall et al. 207 and 208 patents, were filed on the same day as the 864 patent. The 207 patent describes insulating and building board comprising uncoated expanded perlite together with a fibrous substance. The 208 patent describes boards comprising coated or uncoated expanded perlite, asphalt from an emulsion, and a fibrous substance.

The Miscall 872 patent describes a building board consisting essentially of about 35% to about 57% of granular expanded perlite and about 65% to about 43% of asphalt melting at about 100° F. to about 250° F.; the board having a density equivalent to about 25 to 60 pounds per cubic foot. This patent states that the invention relates to panels or boards which may be used as weatherboard, building board, roofing shingles, and imitation brick or stone siding, but does not give any specific examples of such usage or explain how the asphalt content of such boards would be protected from deterioration by the sun. Composition boards produced according to the Miscall patents are commercially available under the trademark "PERMALITE" from Grefco Corporation.

Thermally insulating board, described in Denning U.S. Pat. No. 3,042,578 issued July 3, 1962, is molded from an aqueous slurry and consists essentially of about 60% minus 20 mesh expanded perlite by weight held in the form of a thick sheet by a network of short absorbent vegetable fibers amounting to about 20% by weight. The fiber has absorbed on its exterior surface, asphalt deposited from an emulsion, which is said to increase the friction of the fibers but not to act as a binder. The preferred boards have a perlite to fiber ratio of 5 to 7:1 by volume; or contain about 70 to 80% perlite and 20 to 30% fiber, by weight. The fiber may be Kraft fiber, asbestos fiber, paper pulp or the like. The fibers are so well separated and isolated from each other by the perlite that the boards will not support combustion even though the fiber content is inherently combustible vegetable fiber. Insulating board made according to this patent is commercially available under the trademark "FESCO" board from Johns-Manville Perlite Corporation.

Jakel U.S. Pat. No. 3,841,885 issued Oct. 15, 1974 describes a process for making a nailable, lightweight, fireproof and waterproof construction slab by combining Portland cement, perlite, glass fiber, cellulose pulp, slaked lime and water to form an aqueous mixture which is first formed, and then pressurized to squeeze out the water, and finally, cured.

Jakel U.S. Pat. No. 3,870,777 issued Mar. 11, 1975 describes a cementitious slab produced singly by preparing a flowable aqueous cementitious slurry, and forming a selected quantity of the slurry into a slab shape by vibrating the slurry and then pressurizing the formed slab to squeeze the water out prior to curing. Roofing in the form of thick simulated shakes made according to the Jakel patents is commercially available under the trademark "CAL-SHAKE" from California Cement Shake Co.

Kirkhuff U.S. Pat. No. 3,852,934 issued Dec. 10, 1974 describes complex interlocking simulated roofing shingle arrangements having a body, top and bottom nailing plates, and grooves dividing the exposed surface of the body into a plurality of simulated shakes. This roofing is commercially available under the trademark "BRIAR SHAKE" from Isolite Corporation.

Other types of concrete roofing in the form of simulated wood shake shingles or roofing tiles are commercially available. All such concrete containing slabs are relatively heavy and non-insulating.

In view of the state of the art, it is a primary object of the present invention to provide a light-weight, decorative, fire-resistant, weather-resistant siding or roofing material having good thermal insulating properties.

It is another object of the invention to provide such a roofing material which is relatively inexpensive since it is made from board that is produced in quantity continuously as opposed to the molding of individual cement shakes as in the prior art.

It is still another object of the invention to provide relatively thick roofing simulating the appearance of hand-split wood shakes but at a fraction of the cost of wood shakes and which is also superior to wood shakes in fire-resistance.

It is yet another object of the invention to provide roofing shakes and panels which are shaped, sized and tapered in thickness to facilitate and reduce the cost of installation.

It is a further object of the invention to produce new roofing shakes and panels from available low-cost expanded perlite-fiber-asphate building board; the finished materials being provided with a coating to waterproof the shakes and to protect the underlying building board from deterioration of its asphalt content by exposure to the sun.

It is still another object of the invention to provide such roofing materials having a machined decorative surface exposed to the weather after installation which simulates wood shakes, ceramic tiles or other traditional roofing materials.

SUMMARY OF THE INVENTION

The foregoing and other objects of the invention which will become apparent from the description below, are attained by providing roofing shingles or shakes and panels shaped for ease of installation and cut from commercially available building board composed primarily of expanded perlite, fiber and a binder, usually asphalt, but also optionally including up to about 1% fly ash and/or up to about 7% gypsym, by weight. The shakes or panels, or at least those surfaces exposed to the weather after installation are coated with a material which protects the asphalt content of the building board from deterioration by the sun or more specifically, ultra violet light. As compared to conventional asphalt roofing shingles, the new roofing shakes or panels are of substantial thickness, i.e. from about 0.25 to 1.5 inches and thus approximate or exceed the thickness of wooden shakes or concrete tile.

The new shakes or panels are tapered in thickness to facilitate an overlapping installation. The taper may be uniform from the lower butt end to the upper nailing end as is conventional with wooden shakes. It is preferred, however, for the tapered section to run for only about 1/5 the length of the shake ending at the nailing end. The shakes or panels are designed to be laid in overlapping courses in the conventional manner and thus have an upper, normally overlapped, nailing section and a lower butt section, which is exposed to the weather. The exposed surface of the butt section is normally machined or pressed to provide a decorative appearance such as that of a wood shake or ceramic roof tile, although it may be left plain if desired.

The sun-resistant coating is applied to at least those surfaces exposed to the weather but may be applied to other or all surfaces of the shake or panel if so-dictated by economy and convenience of manufacture. The coating is also preferably water-proof or water-repellant in order to inhibit or totally prevent absorption of water by the roofing. Any suitable water-repellant and sun-resistant coating may be employed including without limitation roofing granules of the type in common use on asphalt shingles; sand or other particulate matter which is preferably crushed to afford planar or plate-like granules; neoprene or other rubber compositions; and vinyl acrylic paints with glass fibers, for example.

The board from which the new roofing is made is normally produced by dewatering a slurry on a Fourdrinier paper-making machine, and drying the board to a dry density of about 10 to 12 pounds per cubic foot. Therefore, depending upon the density of the board and the weight of the protective coating thereon, an installation of these shakes with an average thickness of $1\frac{1}{2}$ inches will weigh about 150 pounds per square (100 square feet of roof area) taking into account the overlapping of the shakes. Therefore this roofing weighs much less than cement shakes or ceramic tiles.

The building board used as the basic for the new roofing, and the protective coatings are both incapable of supporting combustion. Therefore, the new roofing has excellent fire-resistance.

In view of the low bulk density of the building board, the water and sun-resistance of the coatings, the inherent fire-resistance of the board and coatings and relative thickness and inherent insulating properties of the board, the new roofing provided the desired lightweight, inexpensive decorative, fire and weather-resistant roofing having good thermal insulating qualities which has been sought by the art.

BRIEF DESCRIPTION OF THE DRAWINGS

The invention will now be described in greater detail in connection with the accompanying drawings in which.

DETAILED DESCRIPTION OF THE INVENTION

The individual shakes or panels of the present invention normally have a substantial thickness which may vary about 0.25 inches as a minimum to about 1.5 inches or more as a maximum. When the minimum thickness is about 0.25 inches, the maximum thickness of the roofing will be about 0.375 to 0.5 inches. Thinner or thicker shakes or panels can be employed if desired but are not preferred. Shakes thinner than 0.25 inches are undesirable since they have reduced insulating value and do not simulate hand split wood shakes or ceramic tiles as well as thicker shakes. Shakes or panels or simulated shakes or tiles thicker than about 1.5 inches may be used and, of course, provide excellent insulating value but it is seldom necessary or desirable to use such thick roofing due to the unnecessary additional cost and the loss of traditional appearance. Of course, very thick roofing up to 2 inches or more in thickness can be used for decorative or architectural reasons. In general, shakes or panels of about one inch maximum thickness are preferred and adequate to provide good thermal insulation.

Figure 1:
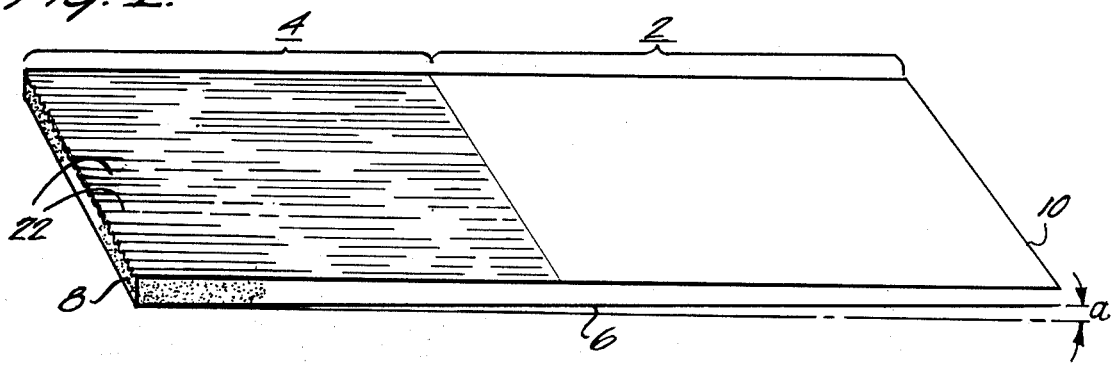
FIG. 1 is a perspective view of a single shake shingle of the invention having a uniform taper.

The simulated wood shake of FIG. 1 has a top surface divided into a plain undecorated upper nailing section 2 and a lower decorated butt section 4. The underside 6 of the shake is uniformly tapered from the relatively thick butt end 8 to the thinner upper end 10. The upper surface of the butt section 4 of the shingle and the butt end 8 can be machined or pressed to provide relatively deep grooves 22, simulating the natural grooves in a hand-split wood shake. These surfaces are exposed to the weather and visible after installation whereas the undecorated nailing section 2 is overlapped by the butt sections of the next course of shakes and is not visible. If desired or convenient in manufacture the decorative machining may be applied to the nailing section 2 or even to the edges and underside of the shakes in order to fully simulate a hand-split wood shake.

Figure 2:
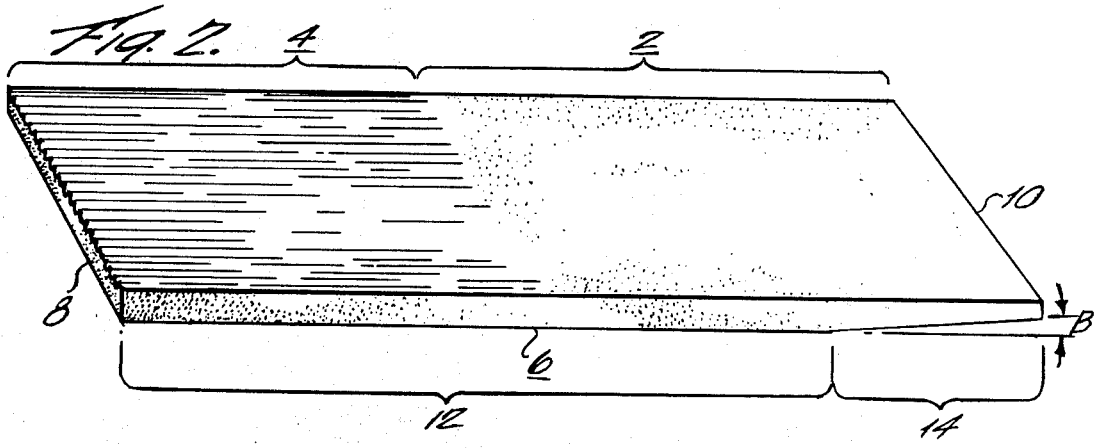
FIG. 2 is a similar perspective view of the single shake shingle of the invention having a taper confined to the nailing end.

The shake of FIG. 2 is similar to that of FIG. 1 except that the underside 6 is full thickness adjacent the but end 8 in the section 12 and is tapered only in the area 14 under the nailing section 2. The sharp taper of the embodiment of FIG. 2 is only about 1/5 as long as the length of the shake and is cut at an angle the tangent of which is equal to the ratio of the full thickness at 8 to the length of the exposed butt section 4.

Figure 3:
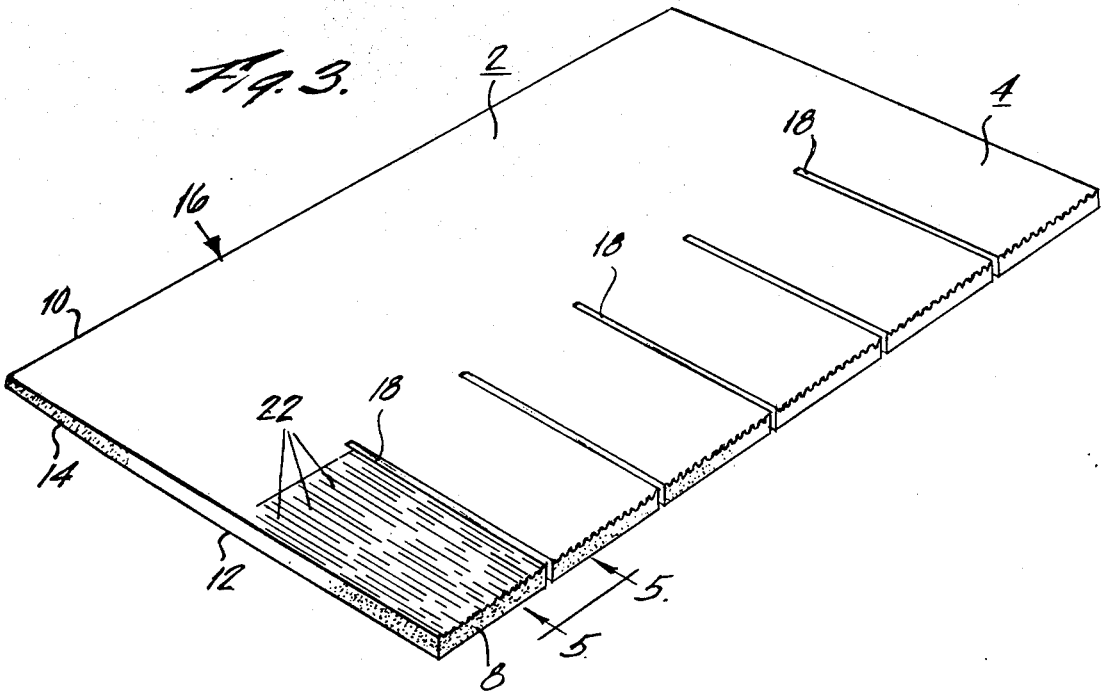
FIG. 3 is a perspective view of a roofing panel of the invention having surface decoration simulating a plurality of wood shakes in a single course.

FIG. 3 illustrates a panel of roofing of the invention which as been decorated on its upper surface to similuate a plurality of shakes installed in a row or course. More specifically, the panel 16 is an integral board having, like the shakes of FIGS. 1 and 2, an upper plain nailing section 2 and a butt section 4 decorated on the upper surface with irregular grooves 22. The butt section 4 is divided by incised grooves 18 in a regular or random pattern to simulate a plurality of individual shakes installed in a row or course. The grooves 18 have a depth less than the thickness of the panel where they occur so that the panel remains an integral unitary structure. However, the grooves 18 may be notched inwardly from the butt edge 18 of the panel so that the integral portion of the panel is not easily visible from the butt end 8 as shown at 20, in order to fully simulate the spaces between adjacent wood shakes in a shingle roof.

The panel 16 in FIG. 3 may have its underside formed like the shake of FIG. 2 as shown, with a full thickness section 12 and a sharply tapered section 14. Alternatively, the panel 16 may have a uniformly tapered underside such as 6 in the shake of FIG. 1. Such a panel preferably measures about 24 inches from butt edge 8 to upper edge 10 and may be from about 5 to 48 inches wide. The simulated individual shakes may suitably be from about 4 inches to about 12 inches wide to simulate from about 4 to 12 individual shakes in a panel.

Figures 4, 5, 6:
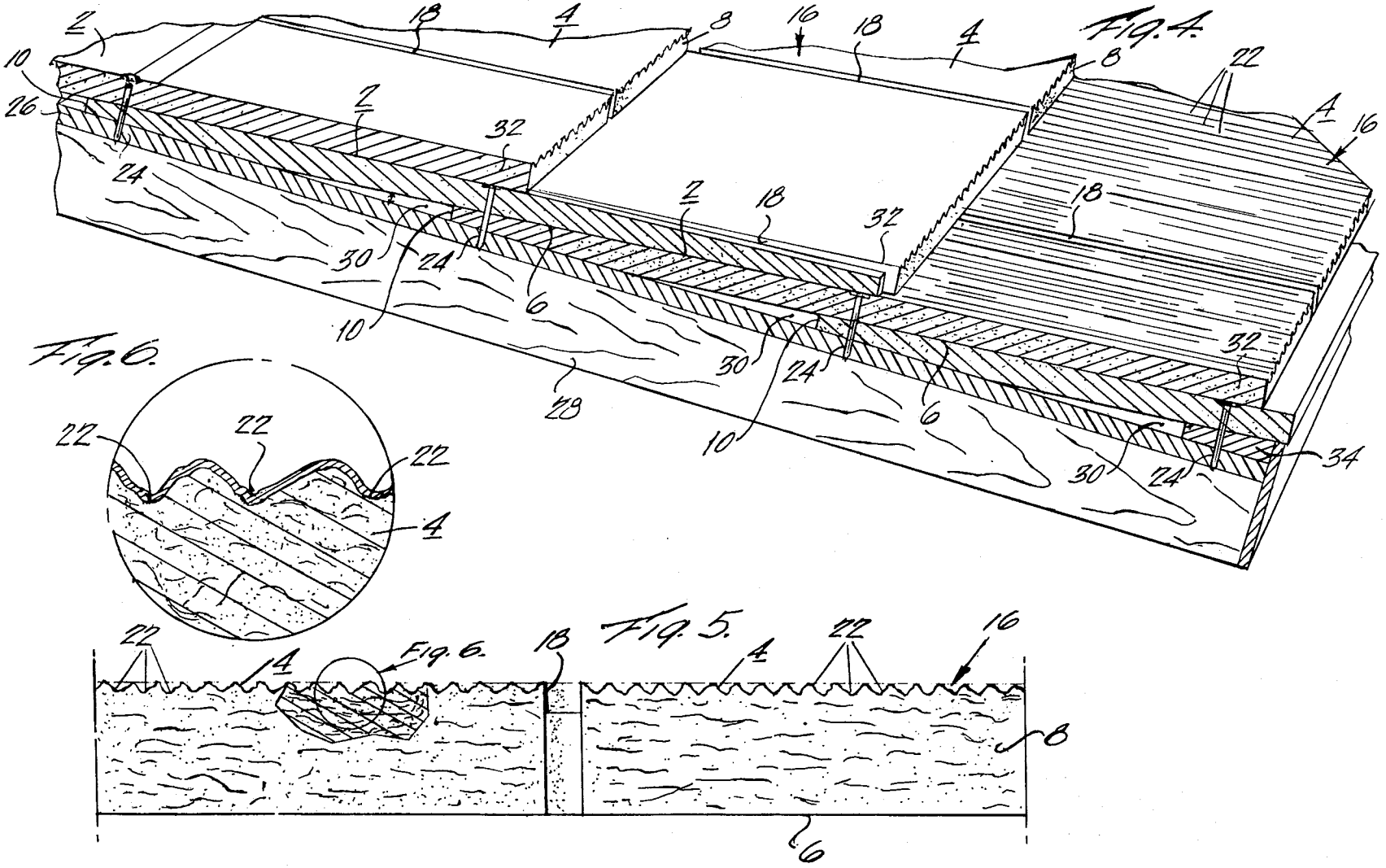
FIG. 4 is a perspective view of a section of roof showing the details of installation of the roofing shakes or panels of FIG. 3
FIG. 5 is a cross-sectional detail view of a portion of the butt edge of the panel of FIG. 3.
FIG. 6 is an enlarged detail view of a portion of FIG. 5 showing the grooves 22.

FIG. 4 shows the installation of the individual shakes of FIG. 2 or the panels of FIG. 3. It will be seen that the roofing is installed over roofing support members 26 supported in turn by the rafters 28. The support members 26 may be plywood or other building board sheathing as shown or may be properly spaced stringers located to receive the nails 24. As will be seen, the heads of the nails or staples 24 are covered and protected from the weather by the overlapping portion 32 butt section 4 of the adjacent course of shakes or section of the adjacent panel.

It is an object of this invention to use commercial insulation board of uniform thickness as a starting material. For economy and ease of manufacture, it is desirable to remove as little of the board as necessary. Therefore, it is preferred to cut only a short taper on the under side of the nailing end. This also leaves more board than would be the case with a long taper thereby giving this roofing system more insulation value. It has been found advantageous for the top surface and most of the bottom surface of a shake to be parallel so that when the shakes are installed in an overlapping fashion as shown in FIG. 4, the bottom of one shake and the top of the shake under it will be in close contact throughout the area of overlap. This minimizes the spaces 30 between shakes and greatly increases the ability of this roofing system to withstand foot traffic. When shakes are tapered throughout their lengths as in the case with wooden shakes and cement tiles of the prior art, there must always be a long unsupported gap between any shake and the shake under it whenever the shakes are installed on a roof of constant slope. This causes the shakes to bend upon being nailed in the case of wooden shakes, or increases the danger of breakage of cement tiles or shakes.

It has been found important, therefore, to cut away a portion of the board under the nailing section to form a taper at an angle the tangent of which is equal to the ratio of the full thickness of the board at 8 divided by the length of the exposed butt section 4. With section 14 tapered at this angle, the shake exactly fits the structure of the roof so that the shake and the roof are in complete contact throughout the length of the taper as seen in FIG. 4. Although the angle of the cut is determined by the thickness of the shake and the length of the exposed butt section, the amount of material cut away can still be adjusted as desired. If only a featheredge remains, at the nailing end, a roofing system is obtained which closely contacts the underlying roof structure at all points so that the gaps 30 under the shakes are very small. This yields the strongest finished roofing but the featheredges of the individual shakes or panels are delicate and susceptible to breakage prior to installation. However, if the cut is made at this same angle but with removal of less material, the nailing end of the shakes or panels is thicker and, therefore, better able to withstand handling prior to installation. This, of course, leaves a longer gap 30 under the shakes upon installation. It has been found that a proper compromise is to cut the shake at the specified angle, but, so that about half of the thickness of the shake is left at the extreme nailing end 10. The length of the cut is determined by the angle specified above. For example, if the shakeis to be 24" long, with an exposed section 4 of 11", and with a double overlap area 32 of 2", then this taper will be 5½" long which is one-half of 11" or the length of the exposed butt section 4. This has been found to be the best compromise between strength of the final roofing system, through the reduction of the length of gap 30 under the shakes, and the strength of the nailing end 10 of each shake to provide sufficient thickness of material so that the shake is not easily broken in handling prior to installation.

The best mode presently contemplated, is to obtain ¾" thick board in 2'×4' sheets from the board manufacturer and to cut away the tapered section at the nailing end using a band saw to remove a piece of material about ⅜" thick and 5½" wide throughout the entire 48" length of the board. The upper side of the board is then passed through a drum grinder, a machine that rotates an abrasive drum that has a pattern cut into it so that as the board is abraded away by the rotating drum, to leave a pattern in the exposed upper surface 4 of the board for a distance of about 11" from the butt end 8. The board is passed under the drum grinder in such a way that the pattern grooves 22 are deepest at the butt end 8 but become more shallow as the board passes through the grinder so that the pattern disappears entirely by the time a point of 11" from the butt end has been reached. It is preferred that the taper cut at section 14 should leave about one half the thickness of the board at the nailing end 10 and that the taper be about one half the length of the exposed butt section. This will provide the specified preferred angle of taper described above. If more material is cut away, the taper is longer and the shake at the nailing end is thinner. This means that more of the shake is in contact with the roof and the gaps 30 between the shakes and the roof are reduced in size. This improves the strength of the roofing system because the gaps are regions where the shakes are unsupported by the roof structure. However, the more the board is cut away at this angle the thinner the shake is at the nailing end. It has been found that a thickness of about ¼" or less at the nailing end yields a shake too fragile for handling prior to installation and should be avoided.

As will be seen from FIG. 4 a starting element 34 is installed at the eave of the roof to fill the space beneath the butt end of the first course of shakes or panels which would normally be filled by the upper end of the adjacent course of shakes or panels.

Turning now to the composition and method of manufacture of the new roofing, the basic element is a commercial expanded perlite-fiber-asphalt building board of the type available as "FESCO" board from Johns-Manville Perlite Corporation or "PERMALITE" board from Grefco Corporation. The "FESCO" boards and their manufacture are described in detail in the Denning U.S. Pat. No. 3,042,578 referred to and summarized above. The "PERMALITE" boards and their manufacture are described in detail in the Miscall et al. U.S. Pat. Nos. 2,626,864; 2,626,872; 2,634,207; and 2,634,208; also referred to and summarized above. The full disclosures of all of these patents are hereby incorporated herein by reference.

While all of the expanded perlite-fibre boards described in the patents referred to above are useful in the present invention, the boards preferred as starting materials are those commercially available boards containing about 50 to about 90%, and about 70% expanded perlite by weight; the remainder being primarily fibers and asphalt, although if desired, up to about 1% fly ash and up to about 5% gypsum, all by weight, may desirably be included. The fly ash would result from the burning of pulverized coal in the perlite expanders and the gypsum would improve the fire resistance of the board without adding much weight. It should be understood that only the expanded perlite, fiber and an asphaltic substance are essential, and that other materials may be incorporated in amounts which do not change the essential character and utility of the boards. The expanded perlite may be of any particle size suggested in the patents referred above, but is preferably substantially all minus 8 mesh, a typical and preferred particle size distribution for the expanded perlite would be about 10% plus 30 mesh, about 50% plus 50 mesh and about 90% plus 100 mesh. The expanded perlite normally has a bulk density of about 4 pounds per cubic foot.

The expanded perlite is blended with any of the asphaltic materials in the patents referred to above and with any suitable fiber including with limitation, pulped newsprint, Kraft or other paper fibers, bagasse, glass fibers and the like. A slurry is formed of this blend as a usual rule and dewatered on a Fourdrinier paper making machine. The webb is then pressed and dried. The resulting building board has a bulk density in the range from about 5 to about 15 or more pounds per cubic foot, and typically about 10 to 12 pounds per cubic foot. The board, which is of uniform thickness, may be made in thicknesses from about 0.5 to about 1.5 inches as stated above.

The boards are produced as a rule in widths of 12 feet on the paper-making machine at a speed of about 40 feet per minute and thus are produced in huge quantities at very low cost. Typically the initial endless board is cut into panels of 2×4 foot size but can be cut to 4×4 foot size or any other convenient size which is a factor of the initial 12 foot width.

After cutting and machining, the roofing shake or panel is supplied with a protective coating using conventional techniques. As noted above, only the surfaces exposed to the weather need be coated, but if it is economic and convenient, other surfaces or all surfaces may be so-coated. Coating may be carried out to some extent prior to the shaping operation, but obviously any surfaces exposed to the weather which are machined must be coated after such machining.

Any suitable weather-resistant coating may be applied to the roofing shakes and panels to protect the board itself against absorption of moisture and the asphalt content of the board against deterioration by exposure to the ultraviolet rays of sunlight. One type of coating suitable for this purpose is the same as that used on conventional asphalt shingles i.e. roofing granules embedded in an underlying coat of asphalt; in this case applied to the exposed surfaces of the board. The roofing granules shield the underlying asphalt adhesive layer and the asphalt in the board from sunlight and thus prevent deterioration. The layer of asphalt used to adhere the granules also serves as an effective moisture barrier to protect the underlying board. Any suitable adhesive layer other than asphalt may also be employed. It is also permissable to employ sun-screening granules other than roofing granules. Suitable granular material includes common sand, crushed stone, expanded perlite, or any other particulate matter capable of shutting out the sunlight. It is preferred that the sun-screening granules be in the form of flakes or platelets having opposed flat surfaces so that they adhere to and cover the surface of the board. Sand and stone can be crushed for this purpose by techniques known in the art.

Light-stable rubber compounds, and particularly synthetic rubbers such as neoprene rubber may be used as the protective coating either alone or as a binder for the roofing granules or other sun-screening particles such as expanded perlite.

Various other surface coatings known to the art may be used to provide sun and moisture resistance and surface strength to the roofing shakes and panels. Vinyl acrylic paints with glass fibers are particularly useful for this purpose but other long-lasting paints such as the recently developed fluorocarbon-containing surface coatings are also highly resistant to weathering. These coatings may be used alone but are preferably used as a binder and adhesive for roofing granules, expanded perlite or other sun-screening particles.

The new shakes and panels when installed on a roof are highly fire-resistant and meet all existing fire codes since the board is inherently incapable of supporting combustion. Moreover, due to the excellent insulating properties of expanded perlite, the very low bulk density of the board, and the substantial thickness of the shakes and panels, the new roofing provides excellent thermal insulation. The shakes and panels are easily cut or sawed with conventional tools and are easily nailed and thus are simple to install. The panels are especially quick and easy to install since the equivalent of 3 to 12 shakes can be positioned and nailed in place in a single operation requiring far less time and effort than installing individual shakes.

The foregoing factors with the very low cost and highly decorative appearance of the shakes and panels makes them clearly superior to the asphalt shingles and cement shakes of the prior art.

What is claimed is:

1. A weather and fire-resistant roofing or siding article such as a shingle or panel having high thermal insulation value, comprising:

(a) a body having opposed inner and outer surfaces composed of insulating board comprising fiber, binder and about 50 to about 90% by weight expanded perlite;

(b) said body having a butt section and an adjacent nailing section, the butt section being substantially uniformly the maximum thickness of the article and having a non-tapered outer surface to be exposed to the weather, said nailing section being of the same thickness as the butt section at the juncture with said butt section, having a non-tapered outer surface, and having an inner surface tapered in thickness in a portion thereof from said maximum thickness to a minimum thickness at one edge thereof remote from said juncture; and (c) a water and weather-resistant coating comprising asphalt and roofing granules on the outer surface of said uniform thickness butt section to be exposed to the weather.

2. An article as claimed in claim 1 wherein said nailing section has a minimum thickness of about one-half the maximum thickness of the article and the length of the tapered portion of the nailing section is about one-half the length of the exposed outer surface of the butt section.

3. An article as claimed in claim 1 wherein the tapered portion is cut at an acute angle relative to the inner surface, the tangent of said angle approximating the ratio of the maximum thickness of the article to the length of the exposed outer surface of the butt section.

4. An article as claimed in claim 3 wherein the length of the tapered portion is about one-fifth the length of the article.

5. An article as claimed in claim 3 wherein the minimum thickness of the article is about one-quarter inch and about one-half of the maximum thickness of the article.

6. An article as claimed in claim 1 wherein said exposed outer surface has the appearance of a wood shake.

7. An article as claimed in claim 1 wherein the insulating board contains up to about 7% gypsum and up to about 1% fly ash by weight.

* * * * *